US011401896B2

(12) United States Patent
Netsu et al.

(10) Patent No.: US 11,401,896 B2
(45) Date of Patent: Aug. 2, 2022

(54) INTAKE PASSAGE STRUCTURE FOR MULTI-CYLINDER INTERNAL COMBUSTION ENGINE

(71) Applicant: Nissan Motor Co., Ltd., Yokohama (JP)

(72) Inventors: Hironao Netsu, Kanagawa (JP); Takuya Taniguchi, Kanagawa (JP); Yukihiro Hayashi, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 383 days.

(21) Appl. No.: 15/578,416

(22) PCT Filed: Jun. 2, 2015

(86) PCT No.: PCT/JP2015/065942
§ 371 (c)(1),
(2) Date: Nov. 30, 2017

(87) PCT Pub. No.: WO2016/194149
PCT Pub. Date: Dec. 8, 2016

(65) Prior Publication Data

US 2018/0216586 A1 Aug. 2, 2018

(51) Int. Cl.
*F02M 35/10* (2006.01)
*F02F 1/42* (2006.01)

(52) U.S. Cl.
CPC ..... *F02M 35/10072* (2013.01); *F02F 1/42* (2013.01); *F02M 35/10078* (2013.01);
(Continued)

(58) Field of Classification Search
CPC ..... F02F 1/42; F02M 35/10072; F02M 35/10078; F02M 35/10085;
(Continued)

(56) References Cited

U.S. PATENT DOCUMENTS 3,984,977 A 10/1976 Morita et al.
5,255,647 A * 10/1993 Kiczek ..... F02F 7/006 123/195 C
(Continued)

FOREIGN PATENT DOCUMENTS

CN 201172781 Y 12/2008
EP 0867610 A2 9/1998
(Continued)

OTHER PUBLICATIONS

Machine Translation of JPH 109049 A PDF File Name: "JPH109049A_Machine_Translation.pdf".*

*Primary Examiner* — Grant Moubry
*Assistant Examiner* — Ruben Picon-Feliciano
(74) *Attorney, Agent, or Firm* — Young Basile Hanlon & MacFarlane, P.C.

(57) ABSTRACT

A sleeve structure comprises a plurality of sleeve main bodies fitted respectively into intake ports of a cylinder head of a multi-cylinder internal combustion engine and a shared base provided on one end of the plurality of sleeve main bodies. By fixing this sleeve structure to the cylinder head, an amount of labor involved in a fixing operation for fixing sleeves to a cylinder head is reduced.

10 Claims, 9 Drawing Sheets

(52) U.S. Cl.
CPC ..... *F02M 35/10085* (2013.01); *F02M 35/10268* (2013.01); *F02M 35/10321* (2013.01); *F02M 35/10347* (2013.01)

(58) Field of Classification Search
CPC ..... F02M 35/10268; F02M 35/10321; F02M 35/10347
See application file for complete search history.

(56) References Cited

U.S. PATENT DOCUMENTS 5,544,629 A * 8/1996 Ohata ..... F02B 75/22 123/184.36
5,875,758 A * 3/1999 Fujita ..... F02M 35/10065 123/336
5,967,116 A * 10/1999 Kawashima ..... F02D 9/1035 123/337
6,988,478 B2 * 1/2006 Tanikawa ..... B29C 65/06 123/184.42
2003/0075135 A1 * 4/2003 Kudo ..... F02M 35/10111 123/184.42
2004/0079348 A1 * 4/2004 Mori ..... F02M 35/10085 123/568.17
2005/0028963 A1 * 2/2005 Niwa ..... F01N 13/1805 165/5
2005/0039730 A1 * 2/2005 Nishida ..... F02M 26/41 123/568.17
2006/0037575 A1 * 2/2006 Enokida ..... F02M 35/1036 123/184.42
2007/0199535 A1 * 8/2007 Shinada ..... F02B 27/005 123/184.57
2008/0178831 A1 * 7/2008 Enokida ..... F02M 35/10104 123/184.61
2009/0241886 A1 * 10/2009 Kameda ..... F02M 35/10222 123/184.21
2010/0251987 A1 * 10/2010 Sano ..... F16K 1/2014 123/184.56
2010/0288247 A1 * 11/2010 Tanikawa ..... F02M 35/10085 123/568.11
2011/0162611 A1 * 7/2011 Zhang ..... F02M 35/10085 123/184.56
2012/0021179 A1 * 1/2012 Ohta ..... B29C 65/069 428/156
2012/0247415 A1 * 10/2012 Kim ..... F02M 35/112 123/184.21
2013/0157534 A1 * 6/2013 Suzuki ..... F02M 61/14 440/88 F
2014/0238330 A1 * 8/2014 Matsuzaki ..... F02B 31/06 123/184.56

FOREIGN PATENT DOCUMENTS

JP S511606 U 1/1976
JP S5170326 U 6/1976
JP S5259805 U 4/1977
JP S5749 U 1/1982
JP S62165444 U 10/1987
JP H109049 A * 1/1998 ..... F02B 77/02
JP H1113564 A 1/1999
JP 2004204796 A 7/2004
JP 2007056794 A 3/2007
JP 2009052491 A 3/2009
JP 2009162065 A 7/2009
JP 2011094515 A * 5/2011

* cited by examiner

INTAKE PASSAGE STRUCTURE FOR MULTI-CYLINDER INTERNAL COMBUSTION ENGINE

TECHNICAL FIELD

The present invention relates to an intake passage structure for a multi-cylinder internal combustion engine.

BACKGROUND

Conventionally, to suppress an increase in the temperature of intake air in an internal combustion engine, intake ports of a cylinder head are connected respectively to branch pipes of an intake manifold via thermal insulating resin-made sleeves.

With respect to this method of connecting a branch pipe of an intake manifold to an intake port, JP2007-056794A, published by the Japan Patent Office in 2007, proposes providing a space between the thermal insulating sleeve and a wall surface of the intake port so that the temperature of the wall surface of the intake port is less likely to be transmitted to the intake air.

JP2009-052491A, published by the Japan Patent Office in 2009, further proposes forming a through-hole in the wall surface of the thermal insulating sleeve so that fuel accumulating in a space on the outside is discharged to the inside of the thermal insulating sleeve.

An operation to fix the sleeve to the cylinder head is performed by preparing sleeves in an identical number to the number of cylinders, and then fixing the sleeves in sequence to the intake ports of the cylinder head. However, the sleeves are mounted individually on the intake ports, and therefore the operation is laborious.

It is therefore an object of the present invention to reduce an amount of labor involved in a fixing operation for fixing sleeves to a cylinder head.

SUMMARY

In an aspect of the present invention, a sleeve structure, which includes a plurality of sleeve main bodies that are fitted respectively to intake ports and a shared base provided on one end of the plurality of sleeve main bodies, is fixed to a cylinder head, and as a result, the object described above is achieved.

DETAILED DESCRIPTION OF THE EMBODIMENTS

Referring to FIGS. 1-6 and FIGS. 7A and 7B of the drawings, a first embodiment of the present invention will be described.

Figure 1:
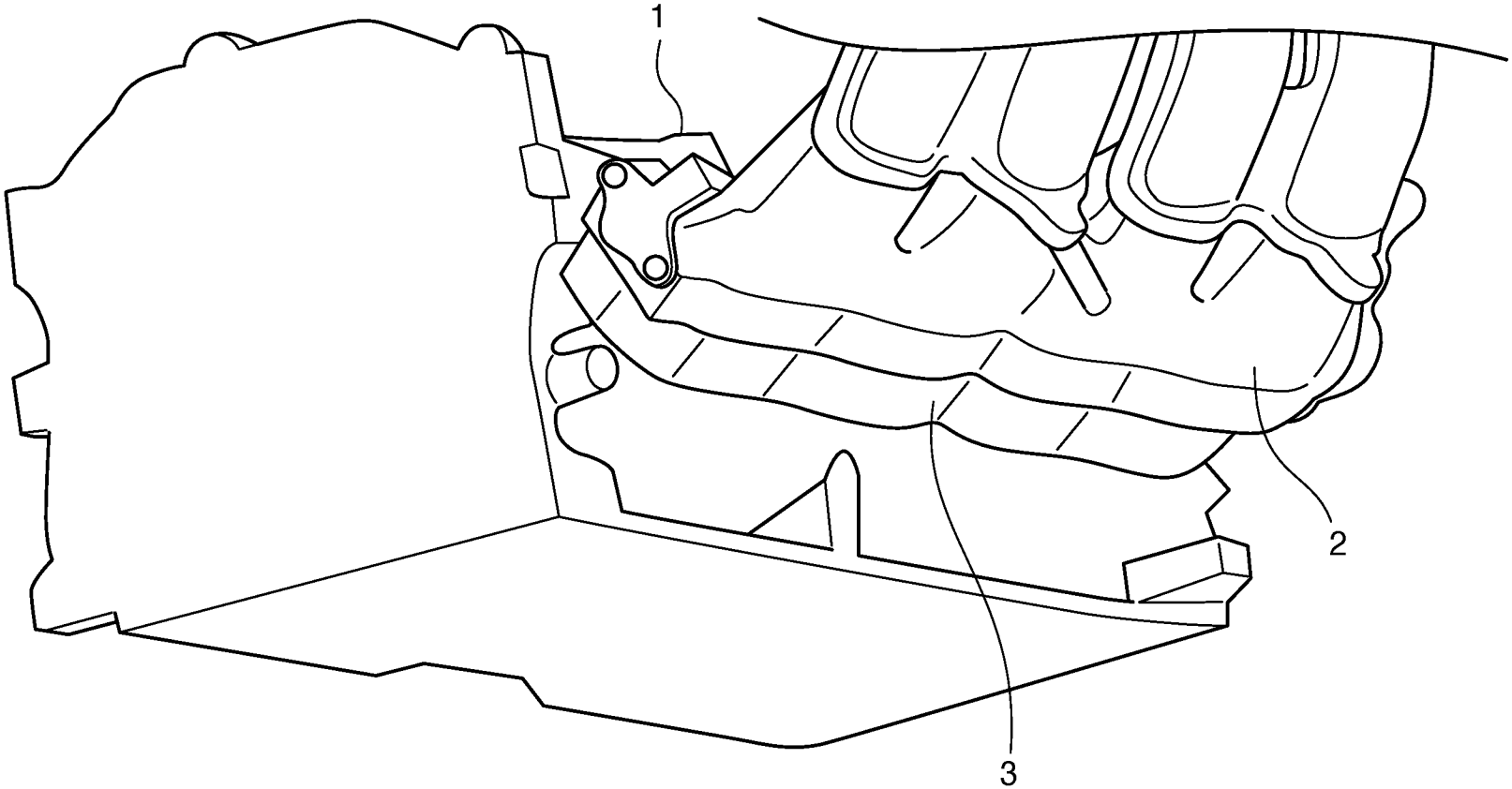
FIG. 1 is a perspective view showing main parts of an internal combustion engine according to a first embodiment of the present invention.

Referring to FIG. 1, an intake manifold 2 is fixed to a cylinder head 1 of a multi-cylinder internal combustion engine. The intake manifold 2 includes branch pipes in an equal number to a number of cylinders of the engine. The branch pipes communicate respectively with intake ports of the cylinder head 1.

In this embodiment, the internal combustion engine has four cylinders, and therefore the intake manifold 2 has four branch pipes. The intake manifold 2 is fixed to the cylinder head 1 via a sleeve structure 3. The cylinder head 1 is made of metal, and the intake manifold 2 is made of a resin that exhibits low thermal conductivity.

Figure 2:
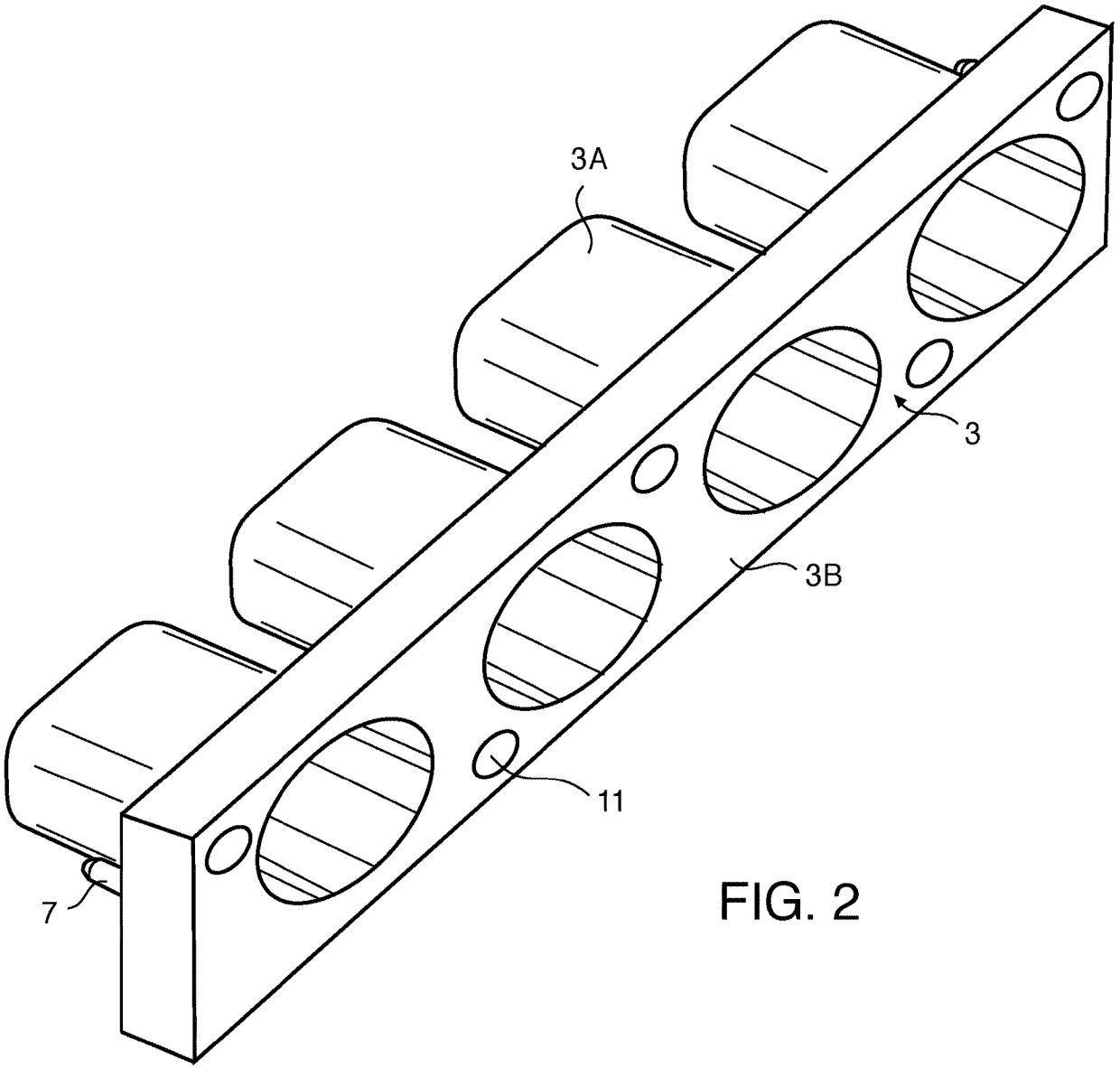
FIG. 2 is a schematic perspective view showing a sleeve structure according to the first embodiment of the present invention.

Referring to FIG. 2, the sleeve structure 3 includes four sleeve main bodies 3A that are fitted to respective inner peripheries of the intake ports, and a shared base 3B provided on one end of the sleeve main bodies 3A. The sleeve main bodies 3A and the base 3B are formed integrally in advance by injection molding, for example, using a resin that exhibits low thermal conductivity. In the figure, the shape of the sleeve structure 3 has been simplified.

The base 3B is formed in a flange shape that can be fitted appropriately to the cylinder head 1, and includes five bolt holes 11 for fixing the sleeve structure 3 to the cylinder head 1. Further, a projection 7 for positioning the sleeve structure 3 on the cylinder head 1 is formed at each end of the base 3B. The projections 7 project from the base 3B in an identical direction to the sleeve main bodies 3A.

Figure 3:
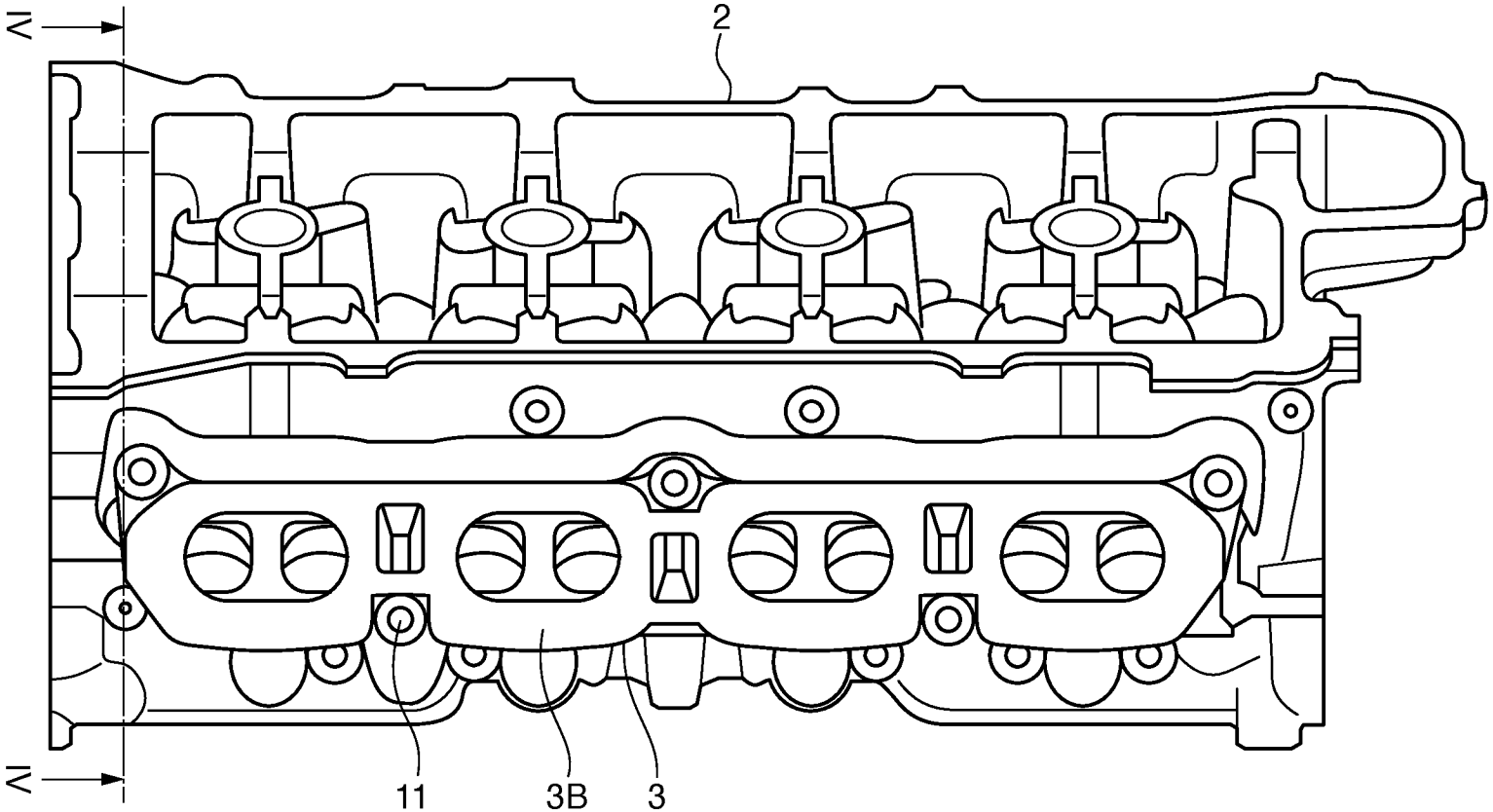
FIG. 3 is a plan view showing a cylinder head to which the sleeve structure according to the first embodiment of the present invention is fixed.

Referring to FIG. 3, the sleeve structure 3 is mounted on the cylinder head 1 such that the sleeve main bodies 3A are fitted respectively into the intake ports and the base 3B contacts the cylinder head 1.

Figure 4:
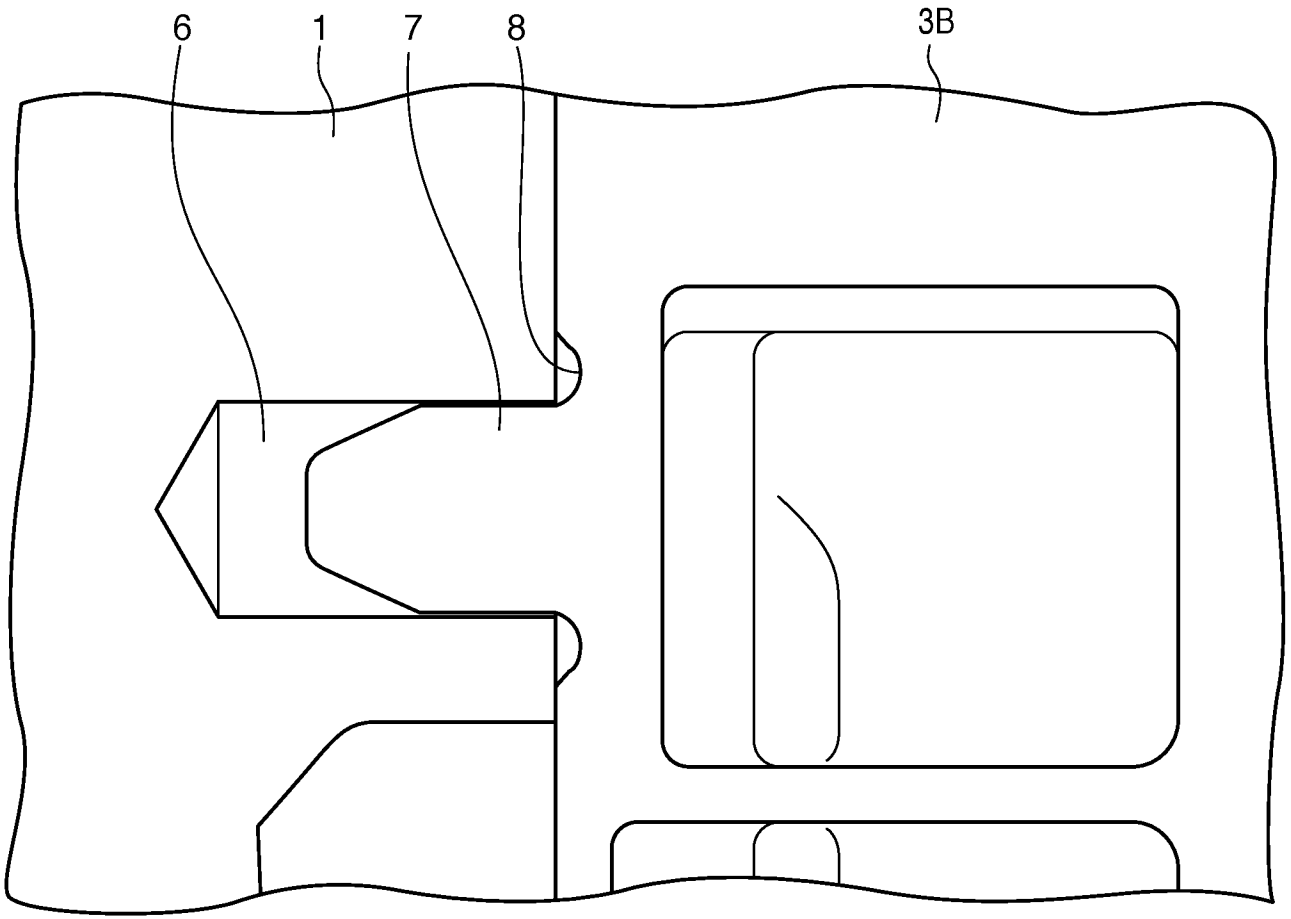
FIG. 4 is a lateral sectional view showing the cylinder head cut along an IV-IV line in FIG. 3.

Referring to FIG. 4, when inserting the sleeve structure 3 into the cylinder head 1, the projections 7 on the respective ends of the base 3B are inserted into positioning holes 6 formed in advance in the cylinder head 1 in corresponding positions. As a result, the sleeve main bodies 3A can be inserted smoothly into the respective intake ports, and the sleeve structure 3 can be mounted on the cylinder head 1 easily. An annular groove-shaped stress-release portion 8 is preferably formed in the base 3B on the periphery of a base portion of each projection 7 to prevent force exerted on the projection 7 in a transverse direction from being transmitted to the base 3B.

Figure 5:
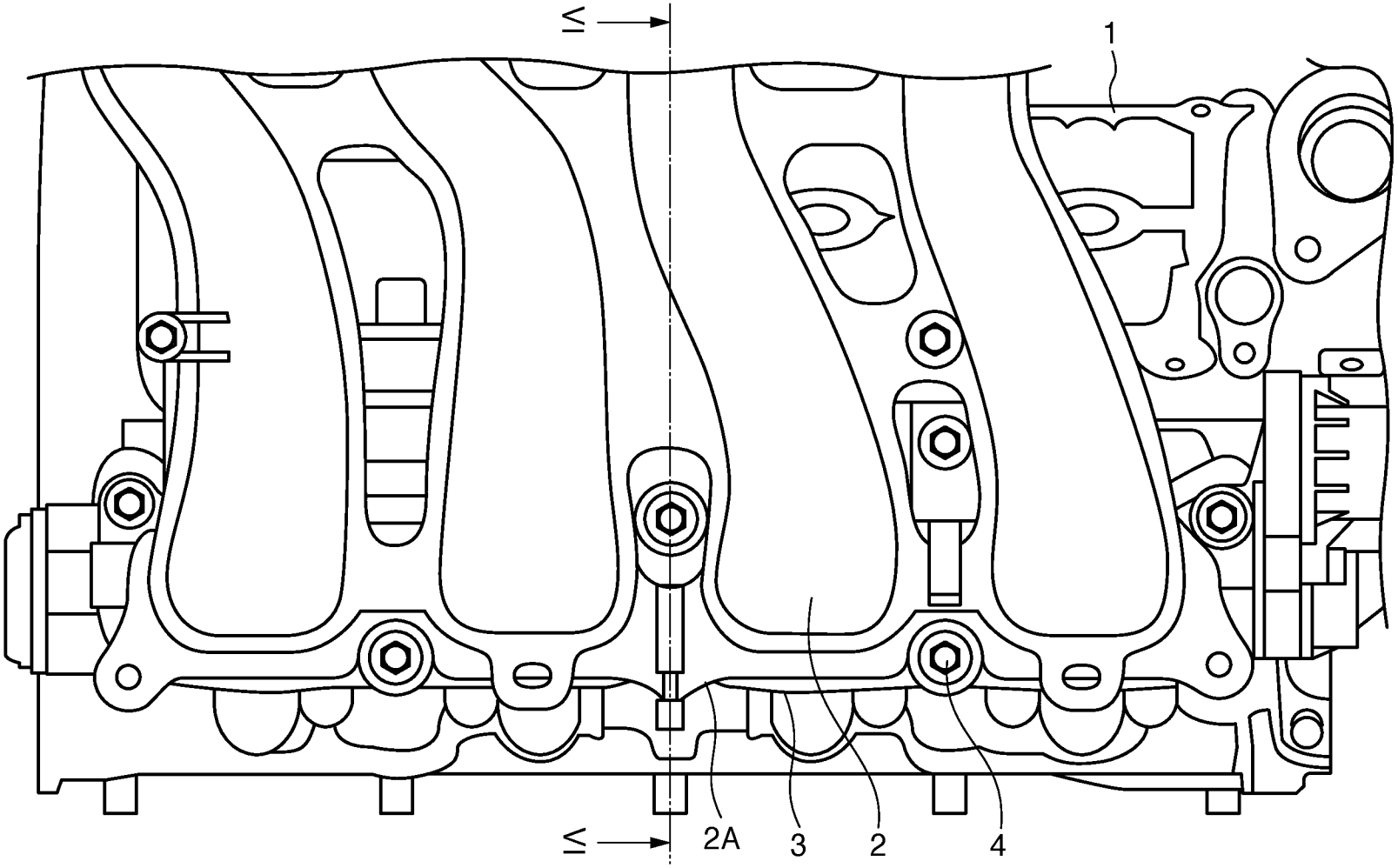
FIG. 5 is a plan view showing a multi-cylinder internal combustion engine to which an intake manifold is connected via the sleeve structure according to the first embodiment of the present invention.

Referring to FIG. 5, after mounting the sleeve structure 3 on the cylinder head 1, the intake manifold 2 is fixed to the cylinder head 1 together with the sleeve structure 3 by bolts 4. As a result, a shared, flange-shaped joint portion 2A is formed likewise on respective opening portions of the branch pipes of the intake manifold 2.

Hence, an intake passage structure of the multi-cylinder internal combustion engine is formed from the branch pipes of the intake manifold 2, the sleeve main bodies 3A of the sleeve structure 3, and the intake ports of the cylinder head 1.

Figure 6:
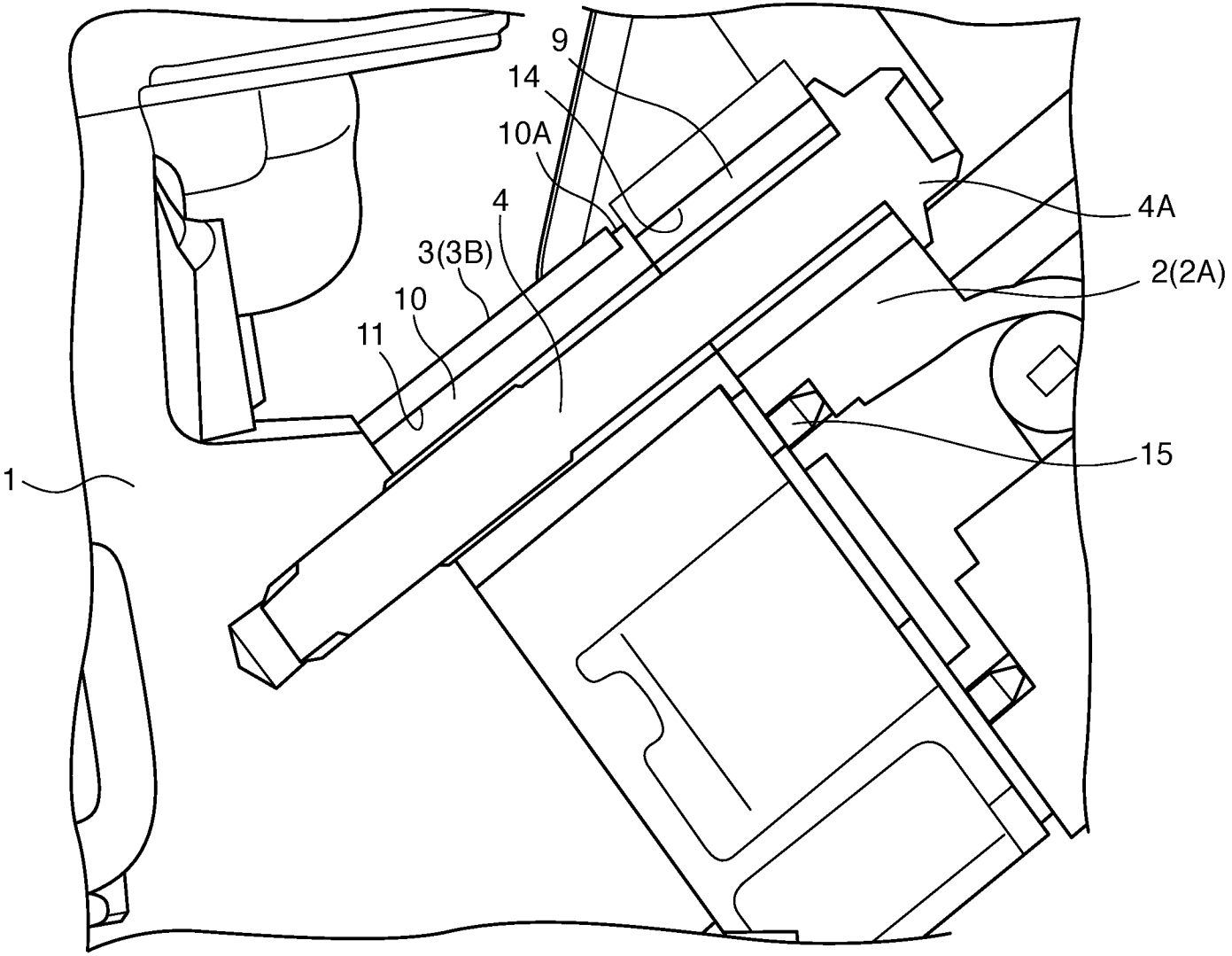
FIG. 6 is a lateral sectional view showing main parts of the cylinder head, the sleeve structure, and the intake manifold cut along a VI-VI line in FIG. 5.

Next, referring to FIG. 6, a preferred structure for fixing the intake manifold 2 and the sleeve structure 3 to the cylinder head 1 using the bolts 4 will be described.

Here, the bolt holes 11 formed in the base 3B of the sleeve structure 3 are formed in advance to have a larger diameter than the bolts 4, and a collar 10 is inserted in advance into the inner side of each bolt hole 11. An inner diameter of the collar 10 is set to be substantially equal to an outer diameter of the bolt 4. Similar bolt holes 14 to the bolt holes 11 are formed likewise in the joint portion 2A on the periphery of the respective outlets of the branch pipes of the intake manifold 2. Separate collars 9 are inserted into the bolt holes 14. The collars 9 and 10 are made of metal.

One axial direction end of the collar 10 contacts the collar 9. A flange portion 10A is formed in advance integrally with this contact site of the collar 10.

Figure 7B:
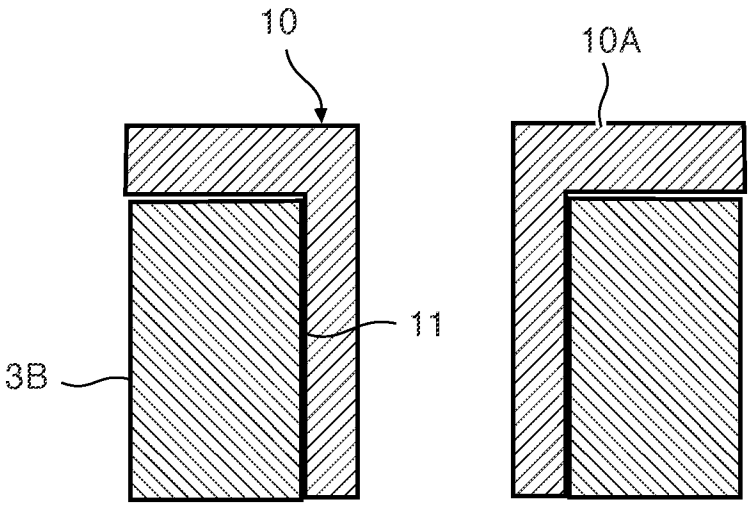
FIG. 7B is similar to FIG. 7A, but shows a condition in which the annular projection is crushed.
Figure 7A:
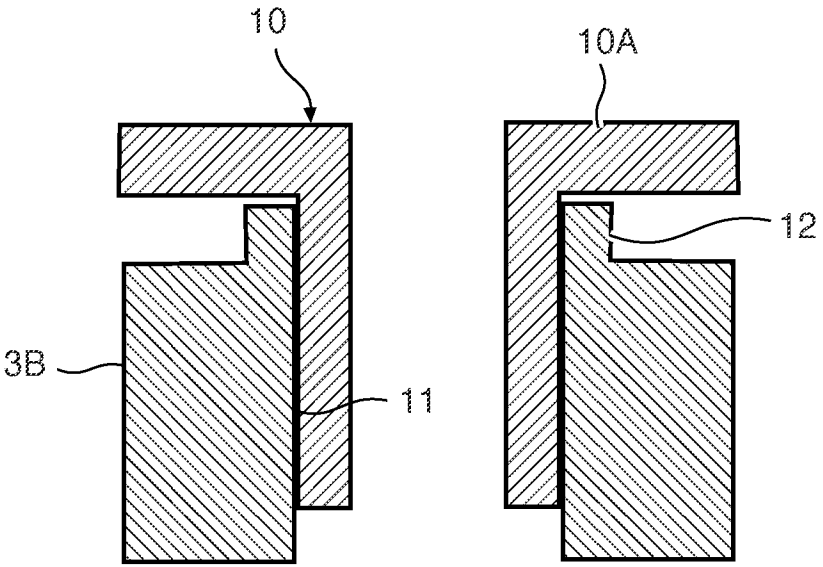
FIG. 7A is a schematic longitudinal sectional view showing main parts of the sleeve structure in order to illustrate a formation condition of an annular projection according to the first embodiment of the present invention.

Referring to FIG. 7A, an annular projection 12 is formed in advance on the periphery of each of the bolt holes 11 in the base 3B of the sleeve structure 3 contacting the flange portion 10A. The collar 10 is inserted into the bolt hole 11 such that the flange portion 10A contacts the annular projection 12.

Referring back to FIG. 6, in a condition where the collar 10 is inserted into the bolt hole 11 and the collar 9 is inserted into the bolt hole 14, the bolt 4 is inserted into the respective inner sides of the collars 9 and 10, whereupon a tip end of the bolt 4 is screwed into a bolt hole formed in the cylinder head 1 and tightened. A tightening force generated at this time exerts a pressing force on the flange portion 10A of the collar 10 from a head portion 4A of the bolt via the collar 9. As a result, as shown in FIG. 7B, the resin-made annular projection 12 is crushed.

By tightening the bolt 4 to the cylinder head 1 in a condition where the annular projection 12 is crushed in this manner, an effect of compensating for creep shrinkage that occurs in the base 3B during an operation of the internal combustion engine, and thereby preventing the bolt 4 from coming loose, is obtained.

In this intake passage structure, as described above, the sleeve structure 3, which includes the plurality of sleeve main bodies 3A that are fitted respectively into the intake ports of the cylinder head 1 of the multi-cylinder internal combustion engine and the shared flange-shaped base 3B provided on one end of the plurality of sleeve main bodies 3A, is fixed to the cylinder head 1. Therefore, instead of fixing the sleeve main bodies 3A individually to the intake ports, the sleeve structure 3, which includes the sleeve main bodies 3A of all of the cylinders, is fixed to the cylinder head 1, and as a result, an amount of labor involved in an operation for fixing the sleeve main bodies 3A to the cylinder head 1 can be reduced.

Further, the sleeve main bodies 3A and the base 3B are made of resin, which exhibits lower thermal conductivity than the cylinder head 1, and therefore an excessive increase in an intake air temperature can be prevented.

In this intake passage structure, the sleeve main bodies 3A and the base 3B are molded integrally in advance, enabling a reduction in a number of components of the internal combustion engine and a reduction in a number of steps required to assemble the internal combustion engine.

In this intake passage structure, a positioning mechanism constituted by the projections 7 and the positioning holes 6 is provided between the base 3B and the cylinder head 1, and therefore the sleeve structure 3 can be mounted on the cylinder head 1 easily and accurately.

The positioning mechanism is structured such that the projections 7 formed on the resin-made base 3B are inserted respectively into the positioning holes 6 formed in the metal cylinder head 1. By forming the projections 7 on the base 3B, which is made of resin and is therefore easy to process, in this manner, a processing operation for providing the positioning mechanism can be executed easily.

In this intake passage structure, the bolt holes 11 are formed in the base 3B, and the bolts 4 are passed respectively through the bolt holes 11 via the collars 10 fitted therein. As a result, the tightening force of the bolts 4 can be prevented from acting directly on the resin-made sleeve structure 3.

Furthermore, in this intake passage structure, the flange portions 10A are provided respectively on the collars 10 so as to be exposed to the outer side of the base 3B opposite the intake manifold 2, and the annular projections 12 are formed on the base 3B in positions opposing the flange portions 10A. Therefore, when the bolts 4 are tightened to the cylinder head 1, the collars 10 are caused to crush the annular projections 12 by the tightening force of the bolts 4, thereby bringing about a favorable effect in that the crushed annular projections 12 compensate for creep shrinkage in the sleeve structure 3 so as to prevent the bolts 4 from coming loose.

In this intake passage structure, the flange-shaped joint portion 2A joined to the base 3B is provided on the intake manifold 2, the through-holes 14 for the bolts 4 are formed in the joint portion 2A, and the separate collars 9 are inserted into the through-holes 14 such that one end of each collar 9 contacts the joint potion 2A and the other end contacts the head portion 4A of the bolt 4. As a result, the fastening force of the bolts 4 can be transmitted to the collars 10 by means of a simple structure.

In the embodiment described above, the sleeve main bodies 3A and the base 3B are formed integrally by injection molding, for example. However, the sleeve main bodies 3A and the base 3B do not necessarily have to be integrated using injection molding.

Figure 8:
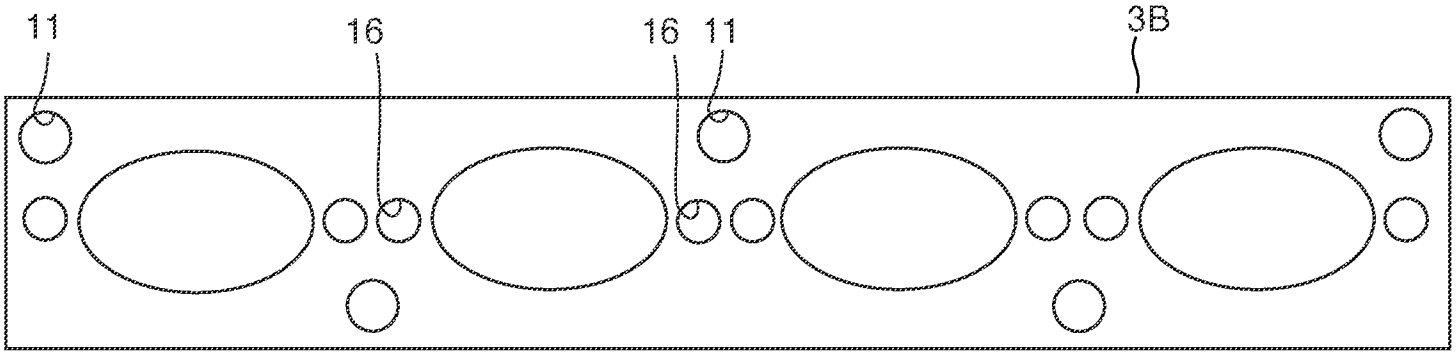
FIG. 8 is a front view showing a sleeve structure according to a second embodiment of the present invention, the second embodiment relating to fixing of a sleeve main body to a flange.
Figure 9:
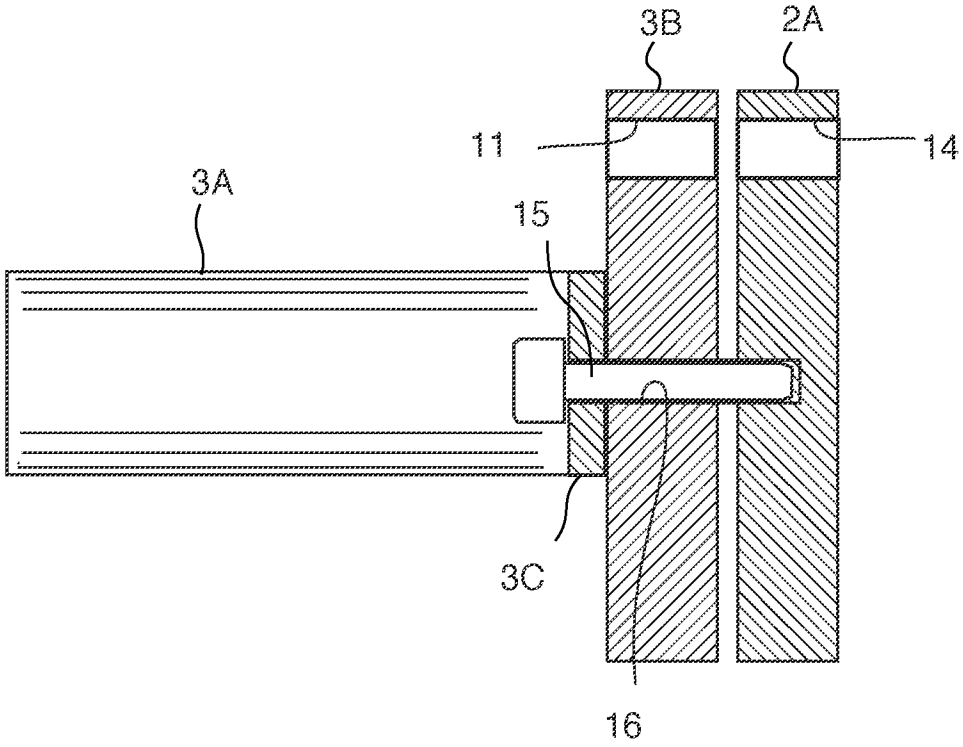
FIG. 9 is a longitudinal sectional view showing main parts of the sleeve structure according to the second embodiment of the present invention.

Referring to FIGS. 8 and 9, a second embodiment of the present invention, in which the sleeve main bodies 3A and the base 3B are integrated without relying on injection molding, will now be described.

In this embodiment, the sleeve main bodies 3A and the base 3B are formed separately. A tab 3C is formed in advance on each sleeve main body 3A in two locations separated by a 180-degree interval.

Referring to FIG. 8, auxiliary through-holes 16 for auxiliary bolts 15 are formed in the tabs 3C and the base 3B. Screw holes into which the auxiliary bolts 15 are screwed are formed in the joint portion 2A of the intake manifold 2.

Referring to FIG. 9, by passing the auxiliary bolt 15 through each auxiliary through-hole 16 in the tab 3C and the base 3B, screwing the auxiliary bolt 15 into the screw hole in the joint potion 2A of the intake manifold 2, and then tightening the auxiliary bolt 15, the sleeve main body 3A is integrated with the base 3B and the sleeve structure 3 is integrated with the intake manifold 2. In this condition, fixing of the intake manifold 2 to the cylinder head 1 is completed by inserting the sleeve main bodies 3A respectively into the intake ports and then, similarly to the first embodiment, passing the bolts 4 through the through-holes 14 and the bolt holes 11, screwing the bolts 4 into the cylinder head 1, and tightening the bolts 4.

According to this embodiment, in comparison with the first embodiment, although the auxiliary bolts 15 are newly required, the sleeve main bodies 3A and the base 3B can be molded individually, and therefore a simpler mold shape can be employed and the molding operation can be performed more easily.

As regards integration of the sleeve main bodies 3A and the base 3B, the sleeve main bodies 3A and the base 3B may be formed separately, similarly to the second embodiment, and then integrated using an adhesive. As long as the sleeve main bodies 3A and the base 3B are integrated as the sleeve structure 3 when the intake manifold 2 is fixed to the cylinder head 1, the present invention is not dependent on the means for integrating the sleeve main bodies 3A and the base 3B.

Further, in the embodiments described above, a single sleeve structure is provided for all of the cylinders, but a configuration in which a plurality of sleeve structures are used, for example a configuration in which two sleeve structures are used for two cylinders each, may be employed instead.

Although the invention has been described above with reference to certain embodiments, the invention is not limited to the embodiments described above. Modifications and variations of the embodiments described above will occur to those skilled in the art, within the scope of the claims.

The invention claimed is:

1. A multi-cylinder internal combustion engine, comprising:
   - a cylinder head having intake ports;
   - an intake manifold connected to the intake ports, the intake manifold having a flange-shaped joint portion at openings thereof; and
   - a sleeve structure, comprising:
     - a plurality of sleeve main bodies made of resin and inserted respectively into the intake ports so as to be attached thereto by fitting; and
     - a shared base made of resin, formed into a flange-shape and located in a plane area that intersects with a flow direction of air in the sleeve main bodies, provided on one end of the plurality of sleeve main bodies,
   - wherein the flange-shaped joint portion is fixed to the cylinder head by sandwiching the shared base between the flange-shaped joint portion and the cylinder head and screwed together by a bolt passed through the shared base,
   - wherein the shared base has a bolt-hole penetrating therethrough and a collar separated from the shared base and inserted into the bolt hole to guide the bolt to pass through the shared base,
   - wherein the collar includes a flange portion that is exposed to an outer side of the shared base opposite the intake manifold, and an annular projection is formed on the shared base in a position opposing the flange portion, and
   - wherein a through-hole for a bolt is formed in the flange-shaped joint portion, and a separate collar is inserted into the through-hole such that one end thereof contacts the flange portion and another end thereof contacts a head portion of the bolt.

2. The multi-cylinder internal combustion engine according to claim 1, wherein the sleeve main bodies and the shared base are molded by the resin and exhibit lower thermal conductivity than the cylinder head.

3. The multi-cylinder internal combustion engine according to claim 1, wherein the sleeve main bodies and the shared base are molded integrally in advance.

4. The multi-cylinder internal combustion engine according to claim 1, wherein the sleeve main bodies are fixed to the shared base in advance by auxiliary bolts.

5. The multi-cylinder internal combustion engine according to claim 1, wherein a positioning mechanism is provided between the shared base and the cylinder head.

6. The multi-cylinder internal combustion engine according to claim 5, wherein the positioning mechanism is constituted by a projection formed on the shared base, and an engagement hole that is formed in the cylinder head and engaged to the projection.

7. The multi-cylinder internal combustion engine of claim 1, wherein the collar is a first collar, and wherein the separate collar is a second collar that is different than the first collar.

8. The multi-cylinder internal combustion engine of claim 7, wherein the flange portion of the first collar is free of contact with a distal portion of the bolt.

9. A multi-cylinder internal combustion engine, comprising:
   - a cylinder head having intake ports;
   - an intake manifold connected to the intake ports, the intake manifold having a flange-shaped joint portion at openings thereof; and
   - a sleeve structure, comprising:
     - a plurality of sleeve main bodies made of resin and inserted respectively into the intake ports so as to be attached thereto by fitting; and
     - a shared base made of resin, formed into a flange-shape and located in a plane area that intersects with a flow direction of air in the sleeve main bodies, provided on one end of the plurality of sleeve main bodies,
   - wherein the flange-shaped joint portion is fixed to the cylinder head by sandwiching the shared base between the flange-shaped joint portion and the cylinder head and screwed together by a bolt passed through the shared base,
   - wherein the flange-shaped joint portion has a through-hole for the bolt penetrating therethrough, and wherein a first collar is inserted into the through-hole such that one end of the first collar contacts the flange portion and another end the first collar contacts a head portion of the bolt,
   - wherein the shared base has a bolt-hole penetrating therethrough and a second collar separated from the shared base and inserted into the bolt hole to guide the bolt to pass through the shared base,
   - wherein the second collar includes a flange portion that is exposed to an outer side of the shared base opposite the intake manifold, and an annular projection is formed on the shared base in a position opposing the flange portion, and
   - wherein one end of the first collar contacts the flange portion and another end thereof contacts a head portion of the bolt.

10. The multi-cylinder internal combustion engine of claim 9, wherein the flange portion of the second collar is free of contact with a distal portion of the bolt.

* * * * *